United States Patent [19]

Wallace

[11] 4,057,218

[45] Nov. 8, 1977

[54] WINCH-HOIST ACTUATING APPARATUS

[75] Inventor: Bernard E. Wallace, Exton, Pa.

[73] Assignee: B. E. Wallace Products Corporation, Malvern, Pa.

[21] Appl. No.: 604,963

[22] Filed: Aug. 15, 1975

Related U.S. Application Data

[62] Division of Ser. No. 453,919, March 22, 1974, abandoned.

[51] Int. Cl.[2] ..... B66D 1/00

[52] U.S. Cl. ..... 254/167; 74/523

[58] Field of Search ..... 254/164, 165, 161, 163, 254/169, 186 HC; 74/524, 523, 543; 81/52.4 R

[56] References Cited

U.S. PATENT DOCUMENTS

| | | | |
|---|---|---|---|
| 2,927,771 | 3/1960 | Clark | 254/164 |
| 3,101,120 | 8/1963 | Huthsing, Jr. | 74/523 |
| 3,279,760 | 10/1966 | Bathum, Jr. | 254/167 |
| 3,401,574 | 9/1968 | Doolittle | 74/524 |
| 3,707,885 | 1/1973 | Profet | 74/524 |

FOREIGN PATENT DOCUMENTS

| | | | |
|---|---|---|---|
| 1,944,173 | 8/1969 | Germany | 74/543 |
| 1,965,032 | 12/1969 | Germany | 74/523 |
| 2,116,004 | 10/1972 | Germany | 74/543 |
| 1,951,684 | 4/1971 | Germany | 74/523 |
| 492,245 | 3/1937 | United Kingdom | 74/524 |

*Primary Examiner*—Robert J. Spar
*Assistant Examiner*—Kenneth Noland
*Attorney, Agent, or Firm*—Synnestvedt & Lechner

[57] ABSTRACT

A handle apparatus, for use in driving the pawl-actuating lever of a winch-hoist, comprising a pair of telescopically-arranged tubes, means for frictionally securing said tubes in selected positions of telescopic adjustment, and an over-load relieving member for linking said handle apparatus with the lever, and comprising: a rod having one end portion mounted within one of said tube members and an opposite end portion adapted to lie within said lever, when the handle is in use, said latter portion being of reduced cross section in two annular zones spaced along its length, at least a portion of one of said zones lying outside and adjacent said lever when the handle is in use, and the material of which said rod is made, and the cross sectional area of said portion of the last-mentioned annular zone, being so chosen that said portion serves as a protecting link bendable in response to application to said handle of force in excess of a predetermined limit; and further wherein the handle has means for housing a spare link.

6 Claims, 15 Drawing Figures

FIG. 1.
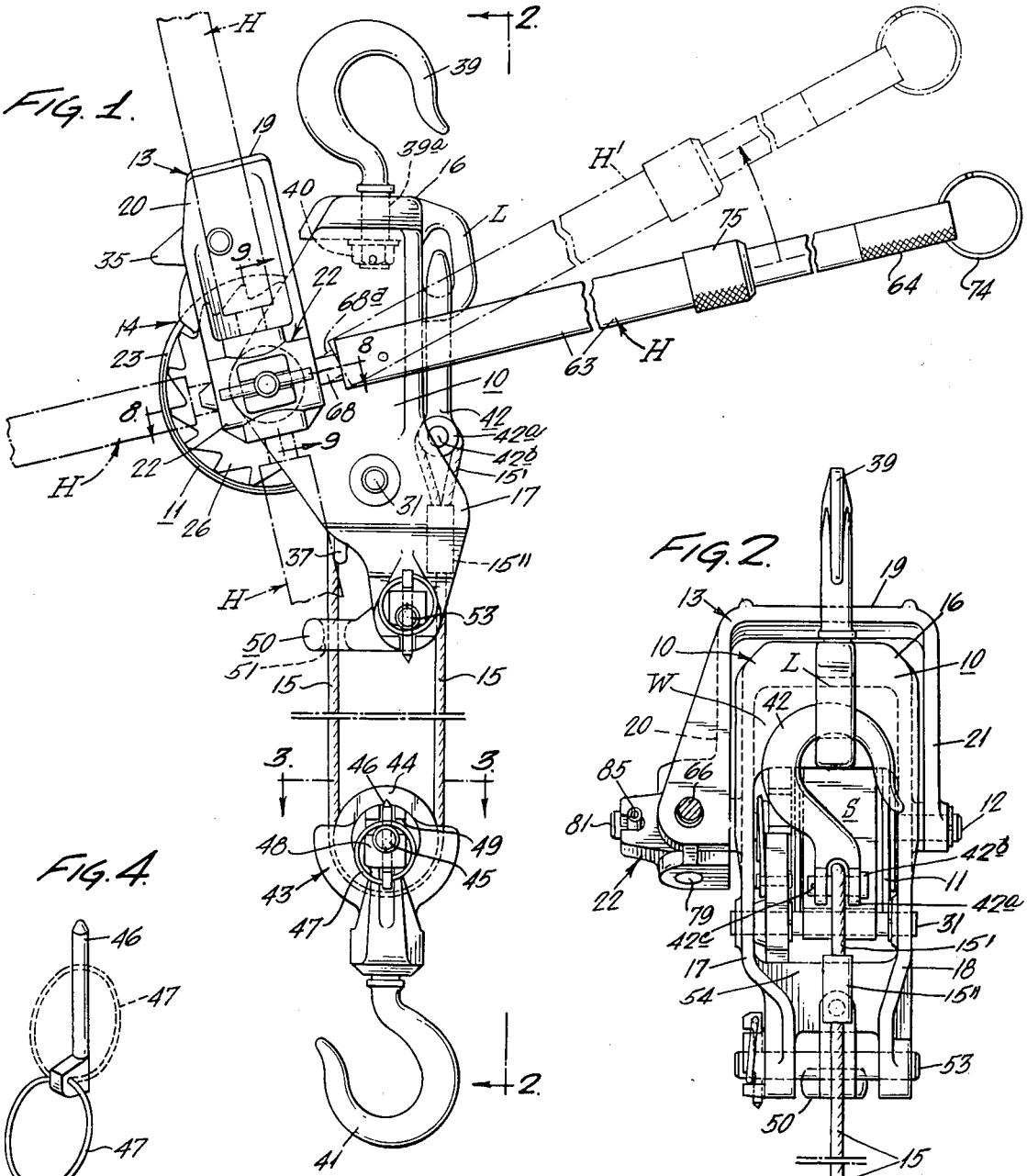
FIG. 2.
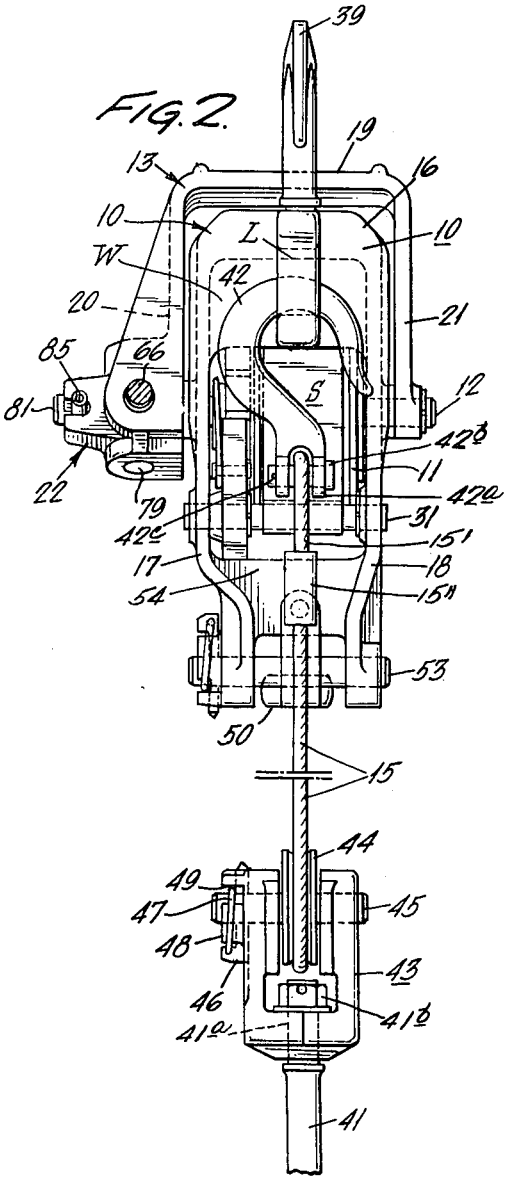
FIG. 4.
FIG. 3.
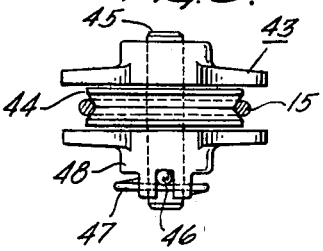

WINCH-HOIST ACTUATING APPARATUS

BACKGROUND AND SUMMARY OF THE INVENTION

This application is a division of my prior, copending, application Ser. No. 453,919, filed Mar. 22, 1974, entitled WINCH-HOIST, now abandoned, and superseded by continuation application Ser. No. 629,262, filed Nov. 6, 1975, which issued as U.S. Pat. No. 4,003,551 on Jan. 18, 1977.

My invention relates to winch-hoist actuating apparatus, and especially for that type of hoist in which a main frame, generally box-shaped in form, has a pair of frame arms between which is rotatably mounted a ratchet-driven drum upon which the lifting cable is reeled, and a U-shaped operating lever has arms which span the main frame, being pivoted thereto for swinging movements about the drum axis. Pawls carried by the main frame and lever are selectively cooperable with the drum ratchet to rotate and control the drum when the lever is pivotally actuated. Some features of such a winch-hoist are disclosed in U.S. Pat. No. 2,633,328, which issued on Mar. 31, 1953.

The patented hoist, just referred to, has a number of commercially proven advantages, particularly in the construction of, and mode of cooperation between, the ratchet and the pawls. However, it has developed that further significant improvements can be made. For example, to protect the user, the hoist and the load, it has been common to design the manually operable handle, which drives the pawl lever, in such a way as to permit bending of the handle when it was subjected to torque in excess of a predetermined limit; but such bending usually rendered the handle unusable. A further disadvantage was that there has been very limited freedom for variably associating the handle with the lever, or no freedom (in the case of integral lever and handle), frequently resulting in having to operate the winch at a short effective lever arm, when the winch was used in tightly confined positions, and/or making it impossible to have a working stroke in the most advantageous direction.

It is the general objective of this invention to overcome all of the aforesaid problems.

The invention also provides a handle which is not only unique and improved per se, but also is cooperable with the hoist at any of four (or more, if desired) angularly related positions, thereby permitting optimization of the operating position and of the "pull angle" without a reduction in leverage; thus avoiding the need for excess effort by the operator. In particular accordance with the present invention, the handle includes a bendable safety link which protects user, load and handle assembly, in the event of serious overloading. Should overloading be encountered, it is only necessary to replace the relatively inexpensive safety link, rather than a complete handle assembly.

The construction is such as to make it very easy to shift the operating position of the handle on the lever, and also very simple to remove and replace the bendable link. It is also a feature, that the handle apparatus of my invention incorporates storage space for spare safety links.

BRIEF DESCRIPTION OF THE DRAWINGS:

In the accompanying drawings:

FIG. 1 is a side elevational view of a portable winchhoist embodying the present invention, illustrating the hoist in one condition of rigging, and showing the operating handle in several positions.

FIG. 2 is an elevational view looking in the direction of the line 2—2 applied to FIG. 1;

FIG. 3 is a view taken as indicated by the line 3—3 of FIG. 1;

FIG. 4 is a perspective view of a securing device, known per se, conveniently used in a novel manner in the sub-assembly shown in FIG. 3;

FIGS. 1-D and 1-S are comparative fragmentary views, generally similar to FIG. 1; but FIG. 1-S illustrating a different rigging of the hoist, i.e., a single-line rigging; while FIG. 1-D shows the double-line rigging of FIG. 1, but with the pulley-block pulled up close to the winch frame structure.

Figures 5, 6, 7:
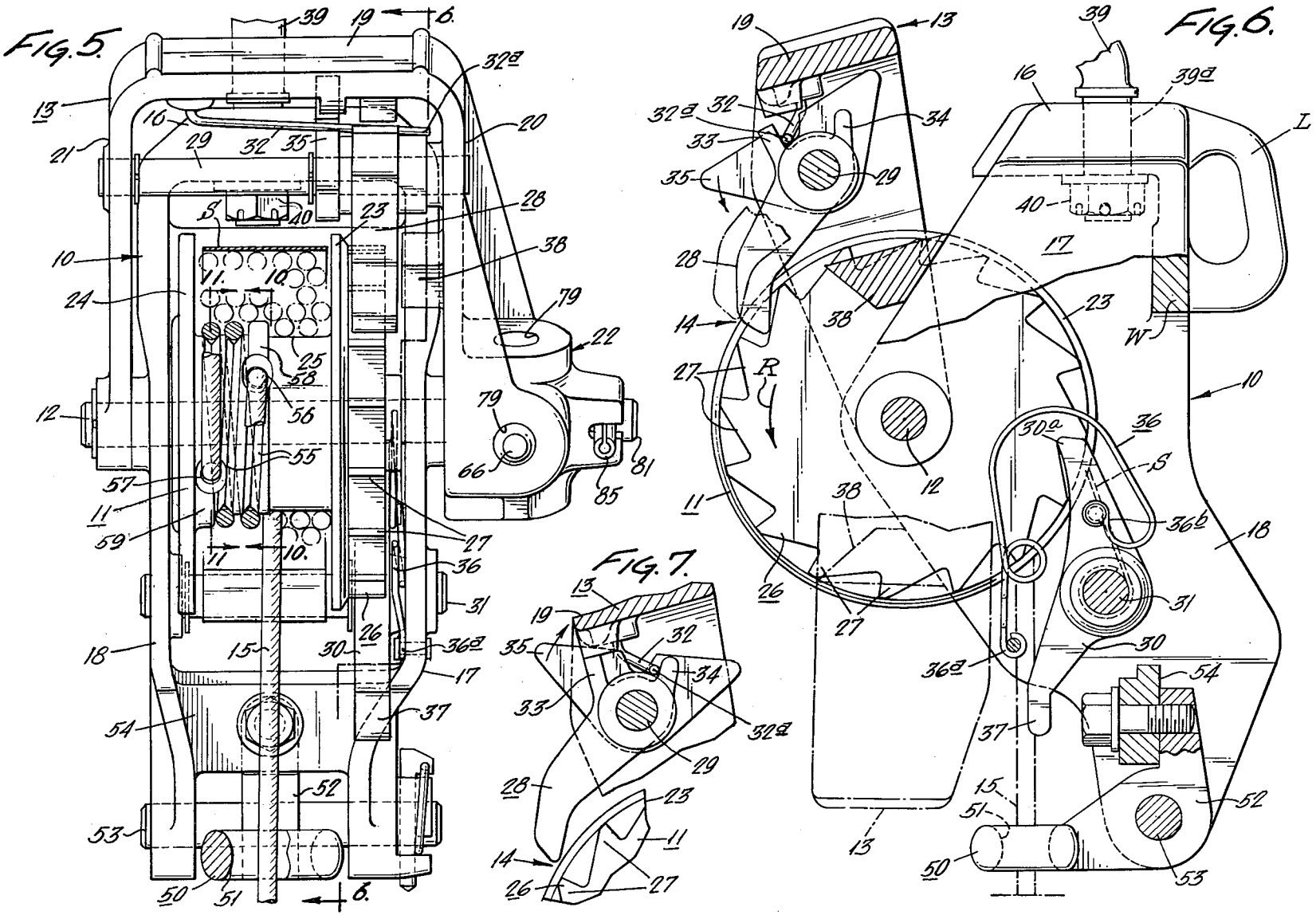
FIG. 5 is an elevational view illustrating, on a larger scale, the apparatus shown in FIG. 1, as it would appear when viewed from the left of FIG. 1.
FIG. 6 is a sectional view taken as indicated by the line 6—6 of FIG. 5.
FIG. 7 is a fragmentary showing of certain pawl mechanism embodied in the apparatus illustrated in FIGS. 5 and 6.

DETAILED DESCRIPTION OF THE PREFERRED EMBODIMENT:

With initial reference to FIGS. 1, 2, 5 and 6, there is shown a winch-hoist comprising: a main frame 10, a drum 11, rotatably mounted on said main frame through the agency of an axle 12; lever means 13, pivoted on said axle 12 for swinging movements about the rotational axis of said drum 11; and ratchet and pawl means indicated generally by the reference numeral 14 (see also FIG. 7) and to which further, more detailed, reference will be made in what follows. The ratchet and pawl means are responsive, selectively, to swinging movements of the lever, to rotate said drum for reeling of cable 15 thereon, and, alternatively, for controlled opposite rotation of the drum for unreeling of cable therefrom, under the pull of the load.

The main frame 10 is of generally box-shape (see FIGS. 2 and 5), comprising an upper cross-member or anchor-portion 16, a pair of spaced vertical walls or arms 17 and 18, and a bottom cross-brace 54. Generally midway of the length of the walls or arms 17, 18, they are provided with confronting apertures which serve to journal the axle 12, which may be secured in the arms in any convenient manner. The lever 13 is of U-shape, comprising a cross-member portion 19 and a pair of spaced arms 20 and 21. The arms 20 and 21 are spaced a distance sufficient to span the width of the main frame 10, as defined by its arms 17 and 18, and the latter arms are received between the arms 20 and 21 of the lever. As clearly appears in the drawings, the axle 12, on which the rotatable drum 11 is mounted, extends through the arms 17 and 18 of the box-shaped frame a distance sufficient to provide for pivotal mounting of the arms 20 and 21 of the swingable lever 13 outside of the frame.

It should be noted that, as shown in FIGS. 2 and 5, the upper portion of frame 10 is of considerably heavier crosssection than the lower portion thereof. The significance of this will be clear from what follows.

Figures 8, 9, 12, 13:
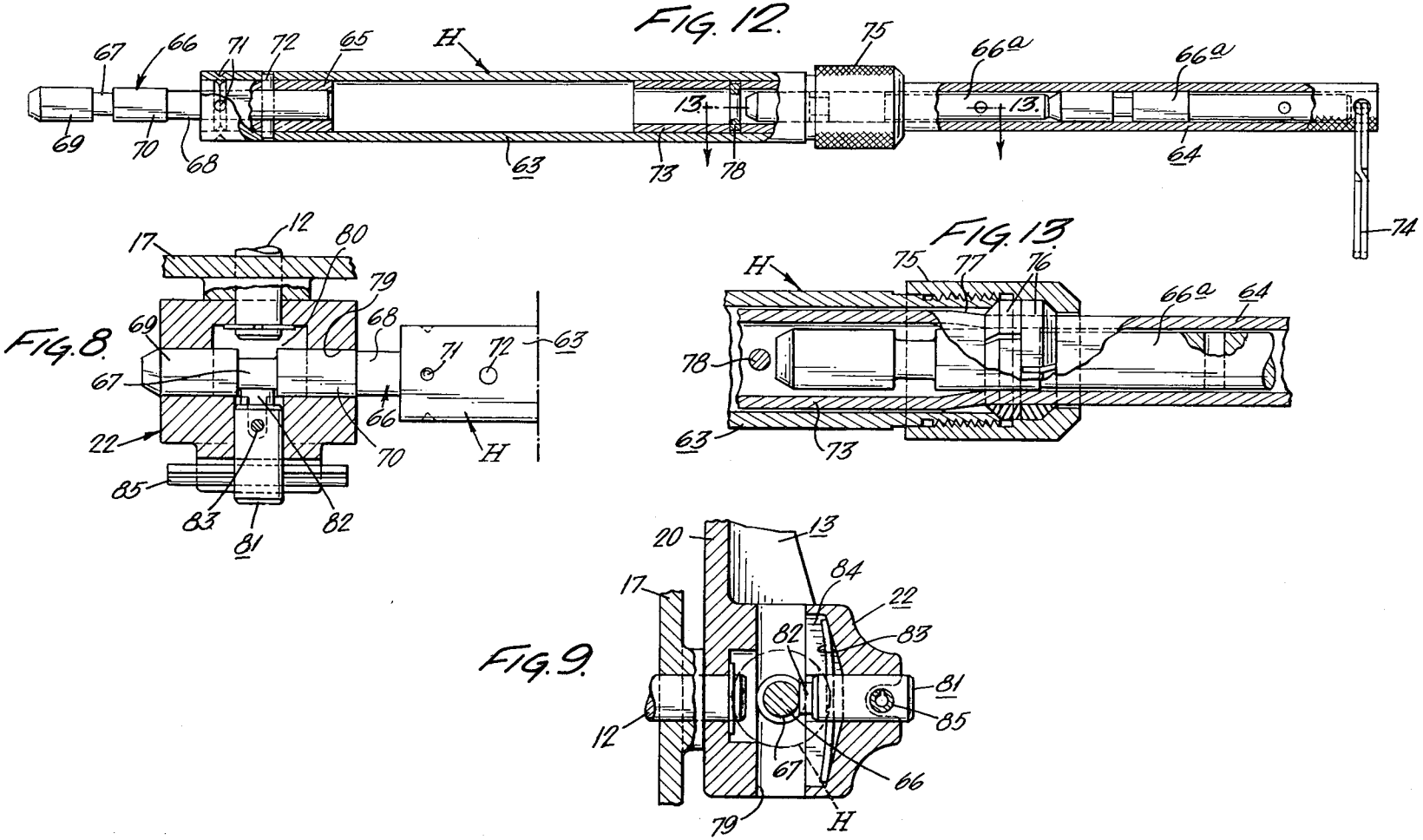
FIGS. 8 and 9 are sectional views taken as indicated, respectively, by the lines 8—8 and 9—9 of FIG. 1, but on a larger scale, illustrating parts of the handle mounting means on the lever, for easy change of handle operating positions.
FIG. 12 is a sectional view of the operating handle.
FIG. 13 is a sectional view, on an enlarged scale, taken as indicated by the line 13—13 of FIG. 12.

The arm 20 of the lever is provided at its free end with an enlarged boss 22, within which is received the operating handle H in a manner to be described in what follows. As shown in FIG. 9, the axle 12 extends within the boss 22 a distance just sufficient to journal the arm 20, thereby affording room for mounting the handle structure to be described.

As appears to good advantage in FIGS. 5 and 6, the drum 11 comprises a pair of spaced flanges 23 and 24 and a hub or barrel portion 25. The flange 23 carries a ratchet wheel 26, preferably formed integrally with flange 23 and carrying a plurality of ratchet teeth 27 (see particularly FIG. 6). When it is desired to reel cable on the drum, the drum must be driven in the direction indicated by the arrow R in FIGS. 6, 10 and 11, and such drive is effected by cooperation between the teeth 27 of ratchet wheel 26 and a pair of pawls, one of which (28) is pivotally secured to the lever 13 by a pin or axle 29, and the other of which (30) is pivotally secured between the arms 17 and 18 of frame 10, by a pin or axle 31. Preferably, the pawls are made of a sintered powdered metal, oil-impregnated, so as to be self-lubricating on their axles. The ratchet and pawl drive is, in principle, the same as the apparatus disclosed in said U.S. Pat. No. 2,633,328. While reference may be had to the disclosure of said patent, for detailed understanding of the functioning of the ratchet and pawl mechanism, such detailed description is not required herein, since this apparatus is not, per se, a part of the present invention. For the purpose of the present disclosure, the following description is sufficient.

Lever-carried pawl 28 can be biased either into or out of engagement with the teeth 27 of ratchet wheel 26, by a spring 32 which has one end retained in the cross-member 19 of lever 13 and its opposite end, **32*a*, disposed between a pair of spaced ears 33 and 34 which project from pawl 28 (FIGS. 5, 6 and 7). A cocking lever 35 is pivotally mounted on rod 29. When this lever occupies the position shown in FIG. 6, the pawl 28 is biased toward its position in contact with the teeth 27. When the cocking lever occupies the position shown in FIG. 7, the spring portion 32*a* biases the pawl 28 out of contact with the teeth 27, as shown. A looped spring 36 has one end 36*a* secured to arm 17 of the main frame, and its other end 36*b* secured to the main frame pawl 30. This latter spring normally serves to bias the pawl 30, which is a holding pawl, toward contact with the teeth 27, although the pawl 30 is movable out of contact with the teeth, either by pressure exerted against a finger release 37 or by cooperative contact between pawl 28 and spring 36** in accordance with the principle described in the above-referenced patent.

In summary, when it is desired to reel cable upon the drum barrel 25, the lever 13 is swung downwardly from the position shown in full lines in FIG. 6, toward the lower position shown in broken lines in said figure. The limiting positions of the lever are established by contact of a lever-carried stop 38 against the upper portion of main frame arm 17, as shown in FIG. 6, or by contact of said stop against the lower portion of said arm, as shown in chain-dotted lines in the figure. In response to such swinging movement of lever 13, the pawl 28, being engaged with one of the teeth 27, carries said tooth downwardly and rotates the drum an increment established by the angular distance between the upper and lower positions of lever 13, or any intermediate amount measured by tooth-by-tooth steps, if desired. The frame-carried pawl 30, which is also biased toward the teeth, serves as a holding pawl, the point **30*a* of this pawl engaging the teeth 27** successively as they pass by, thus preventing retrograde movement of the cable under the influence of the supported load, as will be understood.

When it is desired to permit revere rotation of the drum to lower the load, the cocking lever 35 is moved to the position shown in FIG. 7, in which position the pawl 28 is held out of contact with the teeth 27 of ratchet wheel 26, during downward movement of the lever 13. As the lever 13 approaches the lower position illustrated in FIG. 6, and as is clearly shown in the referenced patent, pawl 28 comes into contact with spring 36 and the said spring is acted upon by the pawl to bias pawl 30 away from the teeth 27. At the same time, the lever-carried pawl 28 is being moved, by contact with spring 36, back into its ratchet-engaging position, against the opposing bias exerted by spring 32. This cooperative movement, which will only take place when the cocking lever 35 is in the position shown in FIG. 7, permits the ratchet wheel to move in the unreeling direction, under the influence of the load, an angular distance defined by one tooth, under the control of the lever.

In short, the ratchet and pawl means described is responsive to swinging movements of the lever 13 to rotate the drum, and thereby reel any cable associated with the drum, and to allow controlled unreeling thereof under the influence of the load.

If a considerable length of cable is to be unreeled, under no-load conditions, the pawl 30 may be held out of contact with the teeth, by exerting pressure against finger release 37.

As shown in FIGS. 1 and 2, the cross-member or anchor-portion 16 of frame 10 is provided with means for anchoring the hoist to fixed structure. In the illustrated embodiment this means takes the form of an anchor hook 39 rotatably mounted within the anchor-portion 16, through the agency of a shank **39*a* and a castellated nut 40**, secured in known manner.

When the cable 15 is looped or doubled back, for amplifying the pulling or lifting capacity of the winch-hoist (which is the rigging arrangement shown in FIGS. 1 and 2), two hooks are normally employed, in addition to the anchor hook 39. These two-hooks are shown at 41 and 42 in FIGS. 1 and 2. In this doubled-back arrangement of the cable 15, the end (which may for convenience be termed the free end) of the cable is formed with an end loop 15', held by the clamp 15''; and this end loop 15' is secured to the hook 42, by means of a clevis **42*a* formed on said hook, and a securing pin 42*b*, which may be held by a cotter pin or the like 42*c*. Hook 42 is secured (in the rigging of FIGS. 1 and 2) to a loop, or eye, L, on frame 10 at a location which provides special advantages, as hereinafter described, (with reference also to FIG. 1-D**).

Figure 10:
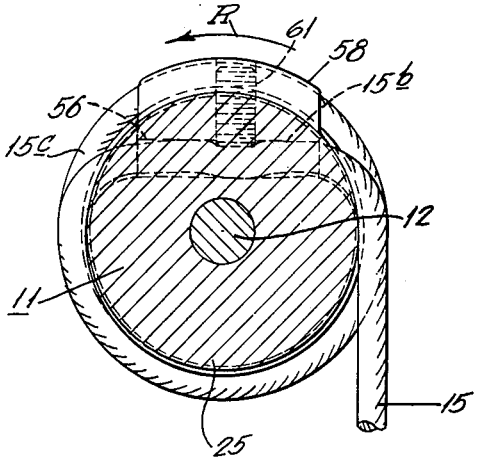
Figure 10:
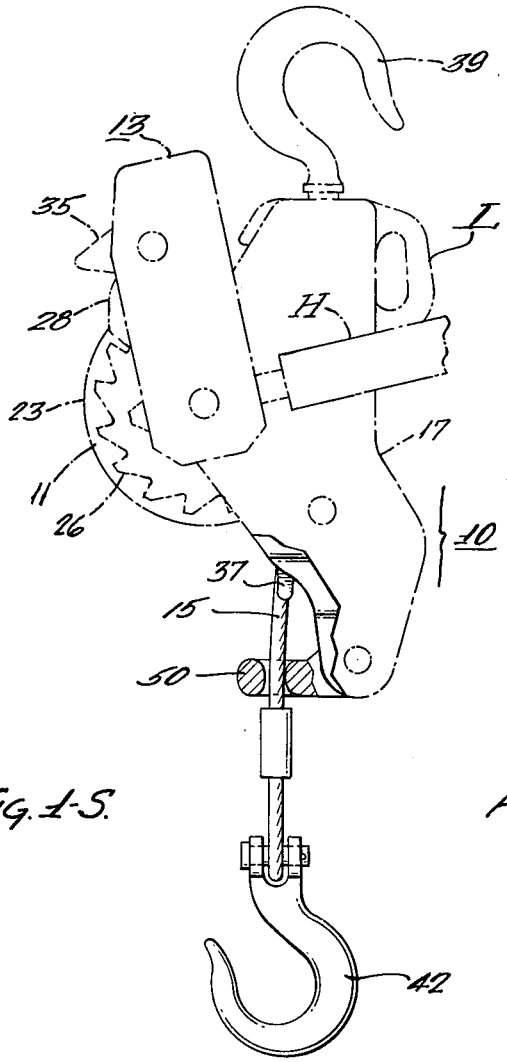
Figure 10:
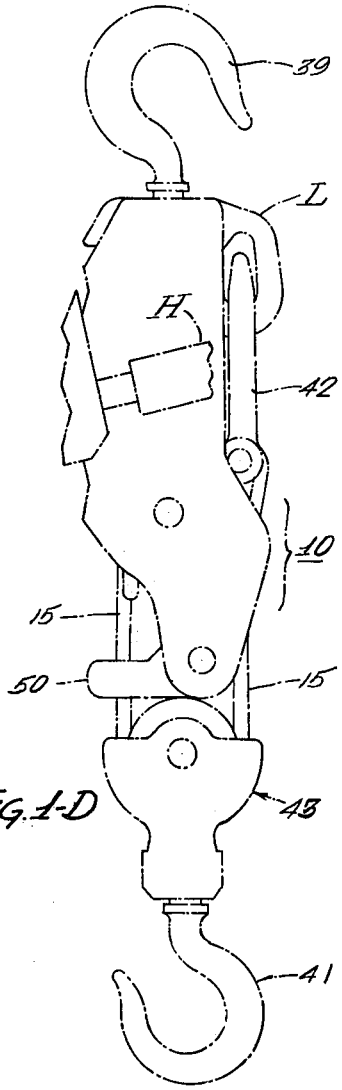

The bight of the light thus formed by the two runs of the cable 15, as shown, carries the hook 41, by means of the pulley-block now to be described.

pull — even as much as several thousand pounds — depending upon cable strength, and the intended load capacity of the winch-hoist, so as to tighten the several turns 15*c* into a snubbing or capstan-like grip on the hub. The screw 61 may then be tightened on the cable portions 15*b* (as seen in FIG. 10) to keep the snubbing portion 15*c* against unintentional loosening. Normally, screw 61 is not turned down as tightly as screw 60 (as is evident from a comparison of FIGS. 10 and 11), because, if a very heavy load is imposed on the cable in actual service, the portion 15*b* may have to have limited freedom to slide or stretch, under the load, so that the snubbing turns will be correspondingly pulled tighter. Screw 61, in some cases, may even be dispensed with, but it does tend to avoid unwanted loosening of the snubbing turns 15*c* when load is taken off the winch-hoist.

As explained above, the illustrated arrangement has the particular advantage that field replacement of the cable is a very simple matter. With either the original cable, or with a replacement cable, it will now be understood that by turning the drum 11 in the direction of arrow R, the second course of the cable will wind across the first course and be laid smoothly thereon, with the aid of the land areas 58 and 59; and the subsequent layers will wind smoothly back and forth. Although shown only fragmentarily in the drawing, at S in FIGS. 5 and 6, the hoist preferably includes a flexible cable shield which contacts the cable and promotes even wrapping on the drum. It also prevents any tendency for the cable to "throw-off" the drum.

As will be evident from the foregoing description, when it is desired to use the hoist with a doubled cable, as appears in FIGS. 1, 2, and 1-D, the free end of the cable, carrying the hook 42, is releasably coupled to the main frame 10 at an upper location of said main frame, rather than beneath the latter, as has been common in the prior art. To accommodate such releasable securement of the cable hook 42, the main frame 10 is provided with the above-mentioned structure L which is looped to form an eye within which the hook 42 is received. The loop structure L is formed upon and projects from the frame cross-portion 16, and from a relatively heavy web W which extends between the frame arms 17 and 18 (FIGS. 2, 5 and 6). Such location of the loop L makes it possible to lighten the hoist to a considerable degree, since frame portions extending below the cross-portion and the web W may be of lesser cross section than the upper frame portions.

The way in which this configuration and construction minimizes the hook-to-hook distance will appear, strikingly, from a comparison of FIGS. 1-D and 1-S. In the double-rigged arrangement (illustrated in detail in FIGS. 1 to 4), though it employs two load hooks, 41 and 42, with hook 41 forming pat of a load-carrying pully-block assembly, the cable can be pulled up, by winding on the drum 11, until the distance from the anchor-hook 39 to the load-hook 41 (as seen in FIG. 1-D) is so shortened as to be quite comparable to the distance from hook 39 to hook 42 in the single-rigged operation (seen in FIG. 1-S), due chiefly to the securing of hook 42 to the loop or eye L adjacent the top of the frame in the double-rigged operation.

Much of the mechanism above-described forms a part of the invention disclosed and claimed in my parent application, Ser. No. 453,919, filed Mar. 22, 1974, but it well illustrates and features the use and advantages of the invention of the present application which is a Division of said application Ser. No. 453,919.

The novel handle H will now be described, as will the structure of the arm of the pawl-carried lever, which accommodates said handle in any of a plurality of different positions — four being employed in the illustrated embodiment. The handle comprises two telescopically-arranged tubes 63 and 64, as appears in FIGS. 1, 12 and 13. The tube 63, which is to be coupled to the lever 13, has nested within it a sleeve 65 (FIG. 12) which is of a size to receive a bendable link 66 which projects axially of the handle for insertion within the enlarged end or boss 22 of lever arm 20. This link may be of steel and is designed to bend in the event of an overload imposed on the handle.

Although it could be made of uniform diameter, with the desired bendability, the link 66 desirably has different diameters at different zones, as will now appear. For example, it is advantageous to make the link of a general diameter large enough to just provide for the maximum bending strength for which it might be called upon in a unit intended for a certain maximum load, but which might be variably adapted for differing maximum loads, and for this purpose a section or zone of it may be turned down to a smaller diameter.

Furthermore, for ready adaptability to being quickly mounted on, and disconnected from, the several different sockets or passages 79 in the lever boss or hub 22, by means of a convenient snap fastener, it is desirable to provide a zone of reduced diameter to engage such a fastener.

In the illustrated embodiment, the link is configured to have two annular zones of reduced cross section. These annular zones are shown in the drawings at 67 and 68, which are thus spaced by larger land areas 69 and 70. When the handle is in use, as will be described in what follows, annular zone 67 and land areas 69 and 70, lie within the arm of the lever means, while a short portion of zone 68 projects from the handle tube 63 and is subject to bending under excessive applied force. Zone 68 may be of one diameter, in its exposed part and in the part housed in tube 63 (as shown); or those two parts may be of different diameters — for example by turning down the exposed part. Also, the housed part may directly fit the inside of tube 63, or may be fitted to an adapter sleeve (as shown). As will be plain from what follows, the exposed portion of the zone 68 bends in response to overloads applied to the handle, thereby protecting the winch, the user, the load, and the handle.

The sleeve 65 may be staked within the tube, as shown in FIG. 12 at 71, and/or a cross pin 72 may be placed radially through apertures provided in tube 63 and sleeve 65 to retain the safety link 66 in position. The outboard tube 64 is of smaller diameter than the tube 63, and is received within the latter tube. Outboard tube 64 has an end 73 (FIG. 13) sized to fit snugly within the inboard tube 63 and, if these two tubes be fully telescoped, the inboard end of portion 73 of tube 64 will bear against the sleeve 65. For clarity in illustration, the two tubes are shown in their positions of substantial relative extension, to form a handle of maximum length, having a ring 74 at one end thereof. The two tubes may be held in any selected position of extension by rotation of an externally knurled and internally threaded ferrule 75, which cooperates with a pair of tapered and split lock washers 76 (FIG. 13) to secure the two tubes against the relative movement. The righthand portion of tube 64 is of a diameter somewhat smaller than the The load-bearing hook 41 is pivotally secured by shank 41*a* and castellated nut 41*b*, to the pulley-block or yoke 43, which is bifurcated, as shown in FIG. 3, to receive a pulley 44 about which the cable 15 is looped, in this illustrated rigging position. An axle 45 releasably secures the yoke assembly, and the axle may be withdrawn from the yoke to disassociate the assembly from the cable.

Retaining means (FIGS. 3 and 4) comprise a pin 46 and a looped spring 47. In accordance with known practice, the pin is insertable within a cross aperture provided in axle 45, in the manner shown in FIG. 3, after which, swinging of the loop, from the lower position illustrated in FIG. 4, to the upper position (see particularly FIG. 1), resiliently engages the spring loop 47 with a boss 48. The latter is formed as a part of the yoke and is relieved, at 49 (FIG. 1), to permit entrance of the spring loop 47. When it is desired to remove this load-carrying assembly from association with the cable and utilize the winch-hoist in the rigging condition which employs a single run of cable, with the hock 42 serving directly to support the load, it is a simple matter to remove the securing pin 46, withdraw the axle 45, and remove the yoke 43 and pulley 44 from the cable. Then, as shown in FIG. 1-S, the hook 42 is uncoupled from the loop L, and the end portion of the cable hangs straight down from the drum, and carries the load directly by means of hook 42.

Cable guide means is provided at the lower end of frame arms 17 and 18, as is illustrated in FIGS. 1 and 2. This guide means comprises a loop of metal 50, apertured at 51, and being of generally bell-crank form, as appears most clearly in FIG. 6. One arm of the bell crank provides the apertured loop 50, while the other arm 52 is journaled to the arms 17 and 18 by an axle rod 53, and said arm 52 is also bolted to a web 54 which forms part of the structure of main frame 10 (FIG. 5), extending between the frame arms.

In fabricating apparatus in accordance with this invention, the frame, lever, and certain other parts have been cast of aluminum alloy. Good results are obtained if the alloy is of the kind specified in the trade as number 356-T-6. As will be appreciated, the principles of the invention are applicable to winch-hoists of various sizes. Hoist capacity may range up to several thousand pounds, a capacity of 2,000 pounds being representative of a small portable winch-hoist. In any particular embodiment, the maximum capacity of the apparatus is, of course, achieved when the equipment is rigged to use multiple runs of cable, for example the doubled cable arrangement, with pully-block as best seen in FIGS. 1 to 3, and FIG. 1-D.

In especial accordance with the present invention, the winch-hoist includes novel means for releasably retaining the cable on the drum 11, by snubbing the cable on said drum. For example, the first few turns of cable on the hub of the drum are so held thereon as to provide a very firm snubbing or gripping effect and cannot be inadvertently loosened in normal use; and yet the cable can be easily removed when desired, and can be replaced, without the need for any unusual type of cable or cable fittings or any special tools. As will be understood, this arrangement, which will now be described in detail, obviates former difficulties involved in removing and replacing worn or broken cable, and permits ready replacement of the cable in the field.

Figure 11:
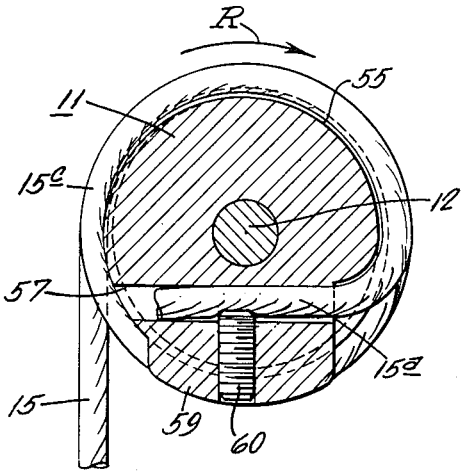
FIGS. 10 and 11 are sectional views taken, respectively, as indicated by the lines 10—10 and 11—11 of FIG. 5, but on a larger scale, illustrating the configuration of the drum hub and the mode of applying the two or more snubbing turns of the cable thereon, and the means for preventing the loosening of said turns.

Now making particular reference to FIGS. 5, 10 and 11, it will be seen that the hub or barrel portion 25 of the drum is provided with a pair of passages to receive certain portions of the cable; and the surface of the drum, in the region of said passages, is desirably provided with helical grooves. The grooves are shown at 55, in FIG. 5, and the grooving is preferably V-shaped in cross section. Such shaping of the grooves assists in the tight gripping of the cable on the drum and increases the snubbing thereof on the drum, during wrapping of the first few turns, as the cable is applied. The cable-receiving passages, one of which appears at 56 in FIG. 10, and the other at 57 in FIG. 11, are spaced axially along the drum in the region of drum grooving, and each passage extends from the drum axis, as is clearly seen from FIGS. 10 and 11. Passage 56 extends through the drum in a mid-region of the axial length of the drum, as seen in FIG. 5. Passage 57 extends through the drum in adjacency to the lefthand flange 24, as the drum appears in FIG. 5.

As explained in more detail below, portions of the cable are disposed within these passages; and a cable holding device is associated with at least one of the passages, and preferably such cable holding devices are utilized at both passages, as will appear hereinafter.

When applying a cable to the drum, the free-end portion of a cable, that is, a portion which would equal several turns around the hub 25 of the drum 11, is threaded through the passage 56 (from right to left as seen in FIG. 10). This portion of the cable is then wrapped around the hub (clockwise as viewed in FIG. 10 — counterclockwise as viewed in FIG. 11), being laid helically in the grooving 55 (seen in those Figures and in FIG. 5) to form the snubbing turns on the drum; and the ultimate end 15*a* of this cable is then pushed into the bore or passage 57 (see FIGS. 5 and 11).

As shown most clearly in FIGS. 10 and 11 a pair of arcuately-curved cable supporting ribs or lands 58, 59, are provided, each being adjacent one of the passages 56, 57. Each land projects above and extends circumferentially around a portion of the hub surface, the projection being about equal to the cable thickness. Land 58 projects above the general hub surface in the region of passage 56, and land 59 projects above said surface in the region of passage 57. The ribs or lands position and support the next layer of cable, as wound on later, in areas where portions of the first few turns extend into passages 56 and 57 of the hub. They also have the advantage of strengthening the structure in the region of the set-screws 60 and 61 now to be described.

The cable holding or securement means referred to above comprises a pair of set-screws or the like, 60 and 61, each of which is received within a recess formed in a corresponding one of said lands. The screw elements are threaded within the drum hub structure, preferably including the land projections, and enter the passages 57 and 56 to engage the cable therein in the manner plainly shown in FIGS. 11 and 10.

It should be understood that the screw devices 60 and 61 are not depended upon to carry the working load on the cable. Rather, they function as follows: After the snubbing portion of the cable has been passed through the bore 56, wrapped a few times around the hub (in the illustrated case, about 2½ turns), and the end 15*a* inserted into bore 57; then screw 60 is turned in tight against the cable-end 15*a*, even to the point of being partially embedded in the cable, as shown in FIG. 11. This can hold the cable-end 15*a* as against a pull of perhaps 100, 200 or 300 pounds. The cable (toward the right, at 15 in FIG. 10) is then subjected to a substantial diameter at 73, the smaller diameter being of a size which just passes through the ferrule 75. The enlarged portion 73 and the tapered portion of tube 64, cannot pass through the split washers 76, or through the outer end of ferrule 75, so that the tube 64 will not be accidentally disengaged, either when adjusting the handle length, or during operation of the winch. When adjusted, the telescopic handle portions are held in the desired position when the ferrule 75 is tightened; and the handle is ready to use.

The outboard tube 64 is sized to receive one or more (in this case two), safety links (see 66*a*) to be kept available as spares. A cross pin 78 (FIGS. 12 and 13) prevents escape of the spare links through that end of the tube 64 which is nested within the tube 63. The ring 74 passes through the tube 64 and is of split type, being readily removable to afford access to the spare links.

Turning now to the novel manner in which the handle H can be associated with the lever 13, and with particular reference to FIGS. 1, 8, and 9, it will be observed that the handle may occupy any one of four different positions, depending upon the convenience of the user, and possible environmental obstructions. One position of the handle appears in full lines in FIG. 1, and three other positions, each separated by 9°, appear in broken lines. The handle is also shown in broken lines at a position indicated by the reference numeral H′, this being a position which the handle might occupy after having been subjected to a force in excess of a predetermined limit. If the handle were subjected to such a force, the exposed annular area 68 would bend as is indicated at 68*a* in FIG. 1. Those portions of the bendable link which are received within the boss 22 of arm 20 of the lever 13 would be supported by the said structure and would not bend significantly.

To accommodate association of the handle at any one of a number of desired locations wihtin the lever 13, arm 20 of the lever is provided with a plurality of (in this instance four) angularly related passages formed in coplanar relation in the enlarged boss 22. All of these passages are identical, and they have been identified by the reference character 79, appearing in FIGS. 2, 5, 8 and 9. In this embodiment, these passages are disposed radially, at 90° angles, about a region of intersection 80, located within the arm of the lever. Detent means 81 projects into this region from a side of the boss 22 (see particularly FIGS. 8 and 9), and enters the region of intersection between the several passages 79. This detent means, which takes the form of a pin, is resiliently held in position in which its nose 82 is engageable within the annular recess 67 of the bendable link 66. Conveniently, the resilient holding means comprises a flexible spring rod 83 which is captive within a slot 84 (FIG. 9) provided in the boss 22. When it is desired to associate the handle with the lever, or to disassociate it therefrom, the pin 81 is withdrawn slightly, against the resilience of spring 83, permitting its nose 82 to be withdrawn from the annular region 67 of link 66. A cross rod 85, which passes through pin 81, may be grasped to withdraw the pin. The described handle arrangement which may be associated with the lever in any one of several different positions makes it possible to optimize the "pull-angle" of the handle.

In summary, apparatus in accordance with the present invention provides an improved winch-hoist in which field replacement of the cable is a simple matter, without the need for cable with special fittings, or special tools, and the hoist may be made lighter, for any given capacity. In addition, these advantages are achieved in a structure which minimizes the hook-to-hook distance, and thereby maximizes the lifting distance and/or the space for a load to be handled.

The novel telescopic handle may be adjusted as to length, for maximum usable leverage, shortening for tight spots or for quick rewind. The novel safety links, and the special manner in which they are associated with the handle and the pawl-carrying lever, provide advantages both as to facility of changing links and as to ease of altering the angular position of handle mounting.

It should be noted that where the operating handle H is shown in full lines in FIG. 1, and in broken lines at H′ in that Figure (indicating the result of exerting an excessive force on the lever); and also with respect to the description as to the most convenient or the most effective position for mounting and/or operating the handle; it should be understood that this is only illustrative. In some, if not most, instances where the winch-hoist is anchored by hook 39 from an overhead structure, the normally desired position of greatest advantage to the operator would be a position where the handle is pulled straight down, when the maximum load is being lifted or lowered.

While a stranded steel cable is typically used in, or associated with, the winch-hoist, it should be understood that the term "cable" is used in a broad sense, to refer to any flexible member suitable for employment in the environment here involved, except where a more specific meaning may be definitely required by the context.

Also, the terms "top" of the winch-hoist, "bottom" of the same, "upper" and "lower" and "right" and "left", and similar terms, are used, for convenience, with reference to the illustrations in the drawings; but it will be understood that this mechanism may be used in an upright position, or in a horizontal position, or even upside down; wherever lifting or lowering or pulling is required; so that the above and similar terms are used simply in an illustrative and not a limitative sense.

In conclusion, it is intended that the entire disclosure be considered as illustrative, and as limited only by the claims, and that the latter be construed as broadly as permitted by the prior art.

I claim:

1. For a winch-hoist of a type having a pawl-actuating lever, handle apparatus for use in driving such a lever, comprising a pair of telescopically-arranged tubes, one of said tubes having an interior hollow formed as a container for removable spare parts, means for frictionally securing said tubes in selected positions of telescopic adjustment, and a member for linking said handle apparatus with such a lever, and comprising: a rod having, toward one end thereof, a pair of land areas; a first annular zone interposed between said land areas and being of a cross section reduced with respect to the cross section of said land areas, said pair of land areas and said first annular zone being cooperative with said lever to releasably secure said rod to said lever; a second annular zone of cross section reduced with respect to the cross section of said land areas, and said second annular zone lying to one side of one of said land areas, extending toward the opposite end of said rod, and said rod having a portion projecting within one of said tubes; and means interposed between said rod portion and said one tube for releasably securing said rod portion within said one tube in a position such that another portion of said second annular zone extends a predetermined distance beyond the end of said one tube, said other portion being bendable in response to application to said handle of force in excess of a predetermined value without bending the handle.

2. Apparatus in accordance with claim 1, wherein said means for releasably securing said rod portion within said one tube includes a sleeve interposed between said tube and rod and sized snugly to receive said projecting portion of said rod, and pin means extending through said tube, sleeve, and projecting rod portion, in a direction transverse to the axis of the handle, said pin means releasably securing said rod within the tube and sleeve.

3. Apparatus in accordance with claim 1, and further including at least one spare linking member nested and releasably secured within said other tube.

4. For a winch-hoist of the character described, having a socket-equipped operating lever and a tubular manually-actuated handle which is adjustable in length and having an interior hollow formed as a container for removable spare parts; an overload-relieving link of rod formation adapted to cooperate with such a lever and such a handle, said link having two spaced-apart seating areas for cooperation with a lever socket to secure said link to said lever, a zone between said areas having a reduced diameter with respect to said seating areas and adapted to cooperate with a removable holding device, and an elongated zone extending from one of said seating areas and into the interior of such handle and including a portion adapted to be exposed and so proportioned as to bend under a predetermined overload without the bending of the handle; sleeve and means interposed between said tubular handle and said elongated zone to releasably secure said elongated zone in the interior of said handle.

5. Actuating apparatus for use in a winch-hoist having an operating lever with a socket, said apparatus comprising:

a. a telescopic tubular handle, with at least its outboard telescopic portion formed as a container for removable spare parts and, at its outermost end, having means of access to said container adapted to permit removal and insertion of said parts;

b. a removable holding device cooperative with said lever socket;

c. an overload-relieving link of rod formation having two spaced-apart seating areas and a zone having a reduced diameter between said areas, and an elongated second zone extending from one of said seating areas;

d. said two spaced-apart seating areas and said first zone being cooperative with said socket, said removable holding device capable of securing said link to the lever socket;

e. said elongated second zone being adapted to extend between said socket and said tubular handle and into the interior of said handle;

f. means interposed between said tubular handle and said elongated second zone to secure said second zone in the interior of said handle;

g. said elongated second zone further being constructed to be capable of bending under a predetermined load without bending of the handle; and h. said removable holding device being configured to interfit with said firt zone of reduced diameter, and adapted to releasably secure the link to the lever socket.

6. Actuating apparatus according to claim 5 for cooperation with a winch-hoist operating lever having a plurality of sockets, wherein said removable holding device is a single pin having a nose, said pin having means for resiliently holding it in operative association with said lever socket, and said nose being engageable with said first zone of reduced diameter, whereby the handle and link may be associated selectively with each of said sockets.

* * * * *